US006164029A

United States Patent [19]

Lee

[11] Patent Number: 6,164,029

[45] Date of Patent: Dec. 26, 2000

[54] SLABSTONE POSITIONING DEVICE

[76] Inventor: Yu-Hong Lee, 6 Fl., No. 1226, Chung Zhen Rd., Tao Yuan City, Taiwan

[21] Appl. No.: 09/154,644

[22] Filed: Sep. 17, 1998

[51] Int. Cl.[7] ..... E04F 13/08

[52] U.S. Cl. ..... 52/386; 52/235; 52/379; 52/513; 52/509

[58] Field of Search ..... 52/235, 378, 379, 52/384–389, 363, 357, 713, 509, 513, 749.1, 745.21, 764, 506.01, 506.05

[56] References Cited

U.S. PATENT DOCUMENTS

| | | | |
|---|---|---|---|
| 1,729,935 | 10/1929 | Froehlich | 52/379 X |
| 2,281,519 | 4/1942 | Faber | 52/363 X |
| 2,326,506 | 8/1943 | Tummins | 52/363 X |
| 3,350,830 | 11/1967 | Smith, Jr. et al. | 52/509 |
| 4,856,246 | 8/1989 | Shimasaki | 52/386 |
| 4,890,433 | 1/1990 | Funaki | 52/386 |
| 5,373,676 | 12/1994 | Francis et al. | 52/387 |
| 5,379,561 | 1/1995 | Saito | 52/235 |
| 5,619,834 | 4/1997 | Chen | 52/235 X |

*Primary Examiner*—Carl D. Friedman
*Assistant Examiner*—Winnie Yip
*Attorney, Agent, or Firm*—Alan Kamrath

[57] ABSTRACT

A slabstone positioning device has a metal positioning plate, an upward bent portion connected to the metal positioning plate, and a triangular downward protrusion disposed on the upward bent portion. At least a nail fastens the metal positioning plate on a cement wall. A slabstone has four slant recesses. An adhesive is applied on each slant recess. Each slant recess receives the upward bent portion of the slabstone positioning device.

6 Claims, 9 Drawing Sheets

SLABSTONE POSITIONING DEVICE

BACKGROUND OF THE INVENTION

The present invention relates to a slabstone positioning device. More particularly, the present invention relates to a slabstone positioning device which can position a slabstone on a wall stably.

An adhesive is applied on a back portion of a slabstone. The slabstone is adhered on a cement wall directly. After a long period of usage, the adhesive may be oxidized and become useless. Then, the slabstone will disengage from the cement wall.

SUMMARY OF THE INVENTION

An object of the present invention is to provide a slabstone positioning device which can position a slabstone on a wall stably.

In accordance with a preferred embodiment of the present invention, a slabstone positioning device comprises a metal positioning plate, an upward bent portion connected to the metal positioning plate, and a downward protrusion disposed on the upward bent portion. At least a fastener fastens the metal positioning plate on a cement wall. The upward bent portion is inserted in a slant recess of a slabstone.

In accordance with another preferred embodiment of the present invention, a positioning device comprises an adjustment seat, a metal positioning plate, an upward bent portion connected to the metal positioning plate, and two triangular downward protrusions disposed on the upward bent portion. A slot is formed on the metal positioning plate. The adjustment seat has a bevel, two lateral plates, and a plurality of through holes. A bolt fastens the adjustment seat and the metal positioning plate together via the slot and the respective through hole. The lateral plates are positioned on a cement wall.

DETAILED DESCRIPTION OF THE INVENTION

Referring to FIGS. 1 to 4, a first slabstone positioning device comprises a metal positioning plate 2*a*, an upward bent portion 21*a* connected to the metal positioning plate 2*a*, and a triangular downward protrusion 22*a* disposed on the upward bent portion 21*a*.

At least a nail 5*a* fastens the metal positioning plate 2*a* on a cement wall 4.

A slabstone 1 has four slant recesses 10. An adhesive is applied on each slant recess 10. Each slant recess 10 receives the upward bent portion 21*a* of the slabstone positioning device.

When the upward bent portion 21*a* is inserted in the slant recess 10, the triangular downward protrusion 22*a* and the upward bent portion 21*a* are confined in the slant recess 10. After a long period of usage, the adhesive may be oxidized to become useless. However, the slabstone will not be disengaged from the cement wall 4.

Figure 1:
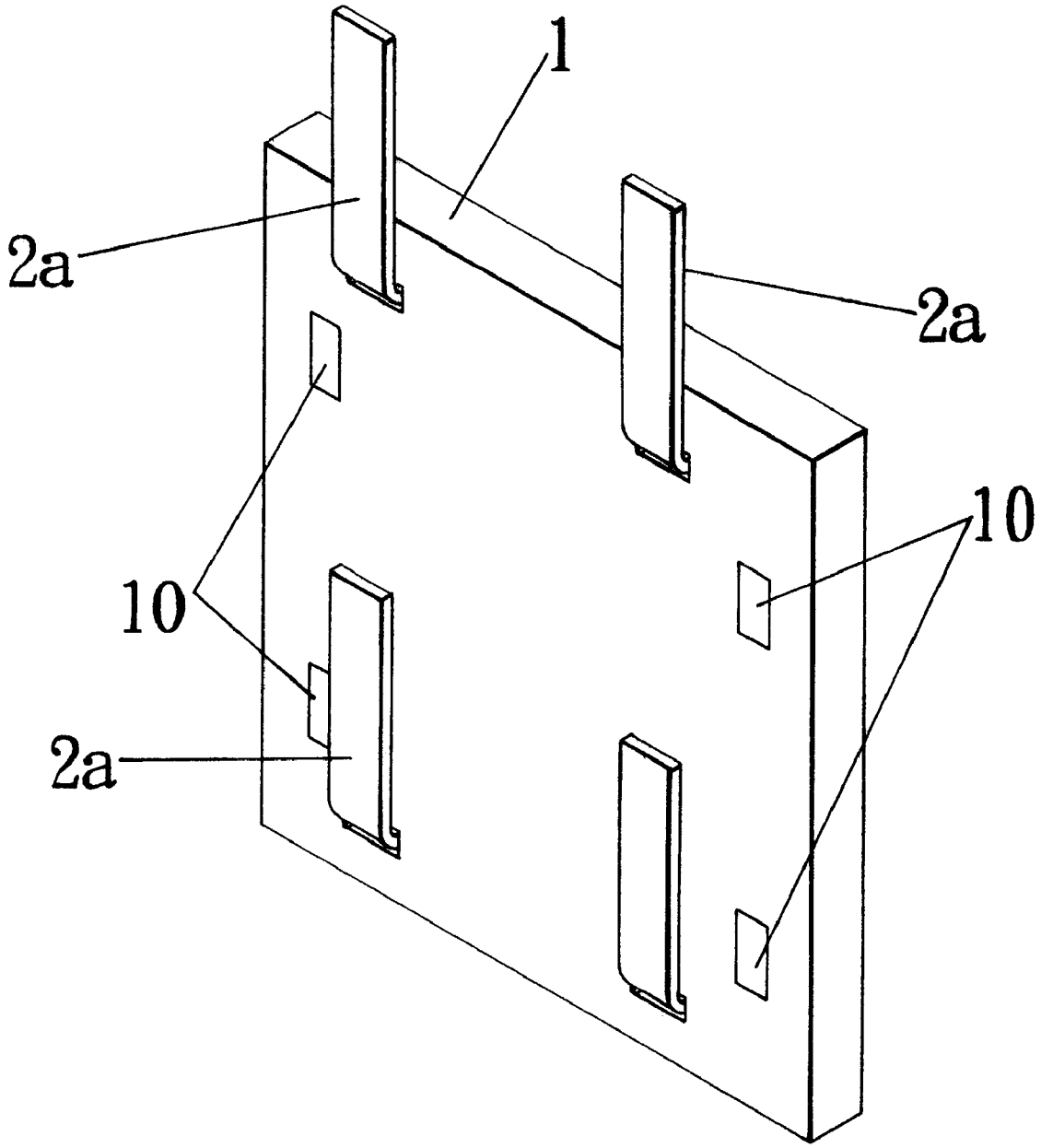
FIG. 1 is a schematic view illustrating four slabstone positioning devices disposed on a slabstone.
Figure 2:
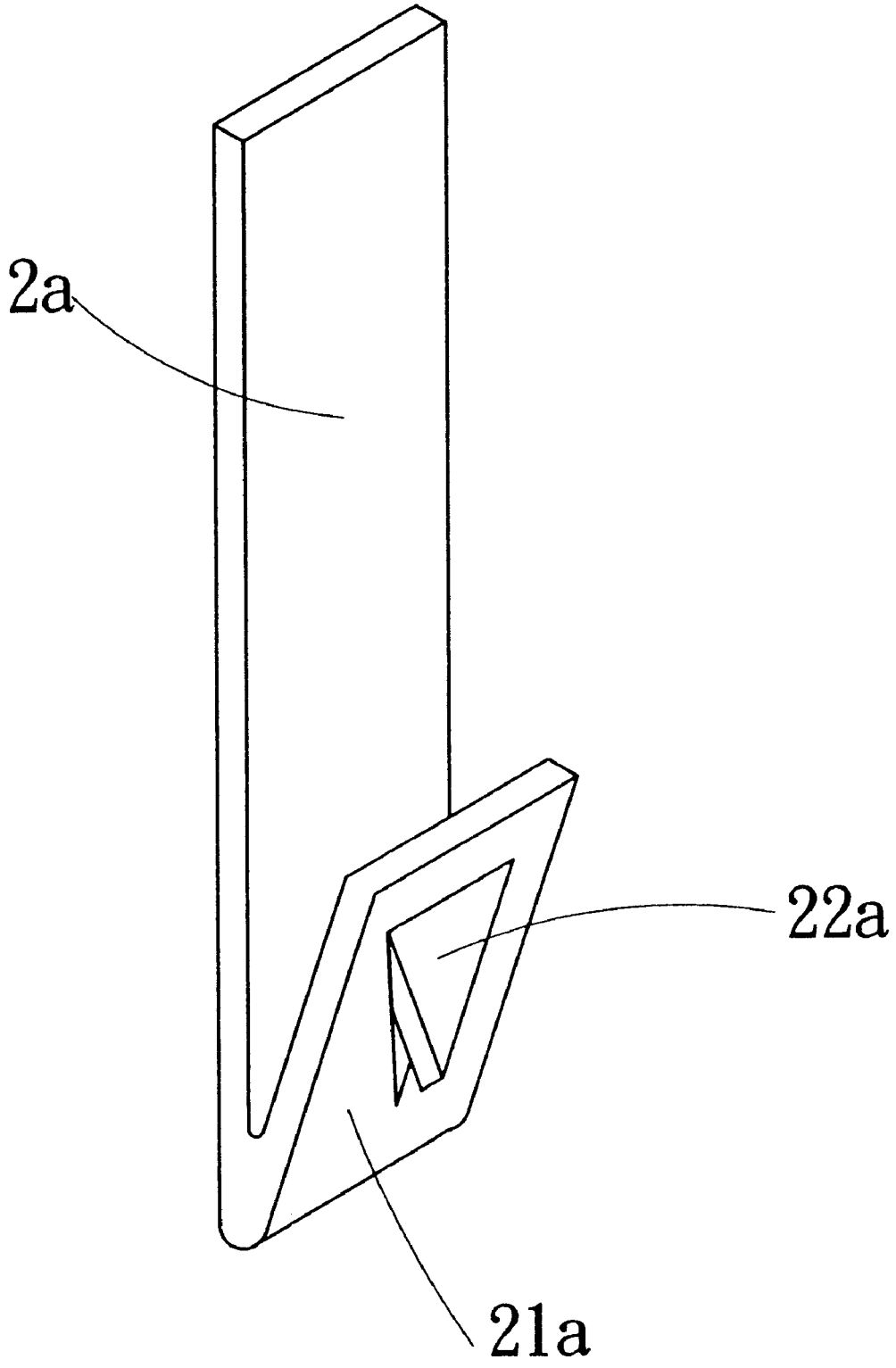
FIG. 2 is a perspective view of a slabstone positioning device of a preferred embodiment in accordance with the present invention.
Figure 3:
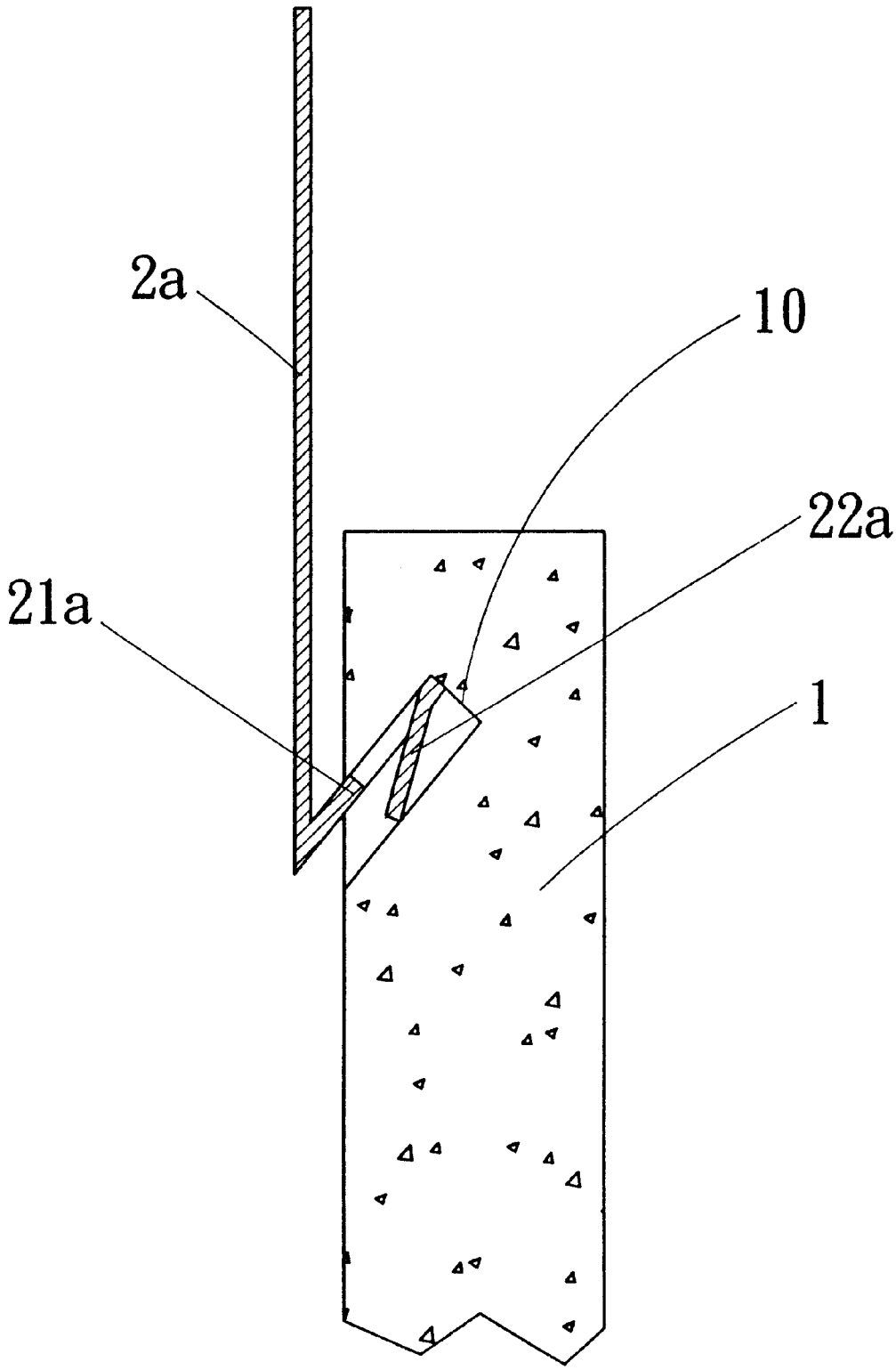
FIG. 3 is a schematic view illustrating an engagement of a slabstone and a slabstone positioning device.
Figure 4:
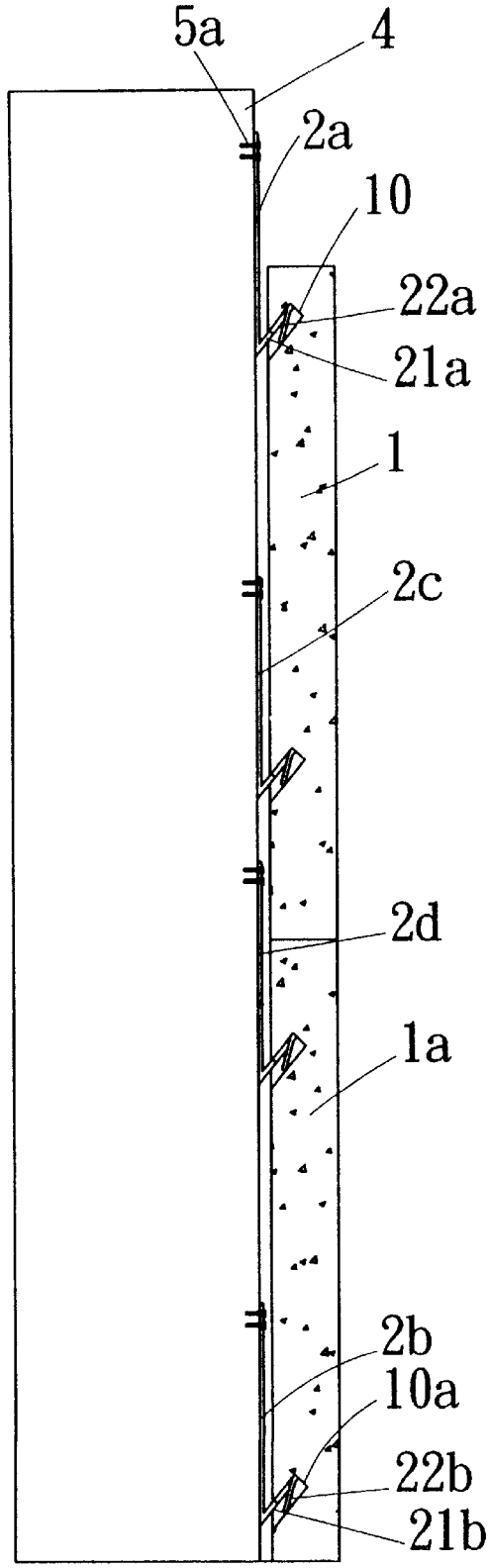
FIG. 4 is a schematic view illustrating an engagement of a slabstone and four slabstone positioning devices of a preferred embodiment in accordance with the present invention.

Referring to FIG. 4, a second slabstone la is placed adjacent to the first slabstone 1. A second slabstone positioning device comprises a metal positioning plate 2*b*, an upward bent portion 21*b* connected to the metal positioning plate 2*b*, and a triangular downward protrusion 22*b* disposed on the upward bent portion 21*b*. The upward bent portion 21*b* of the second slabstone positioning device is inserted in a slant recess 10*a* of the second slabstone 1*a*. A third slabstone positioning device comprises a metal positioning plate 2*c* positioning the first slabstone 1. A fourth slabstone positioning device comprises a metal positioning plate 2*d* positioning the second slabstone la. The second slabstone la should be arranged first. The first slabstone 1 is arranged later.

Figure 5:
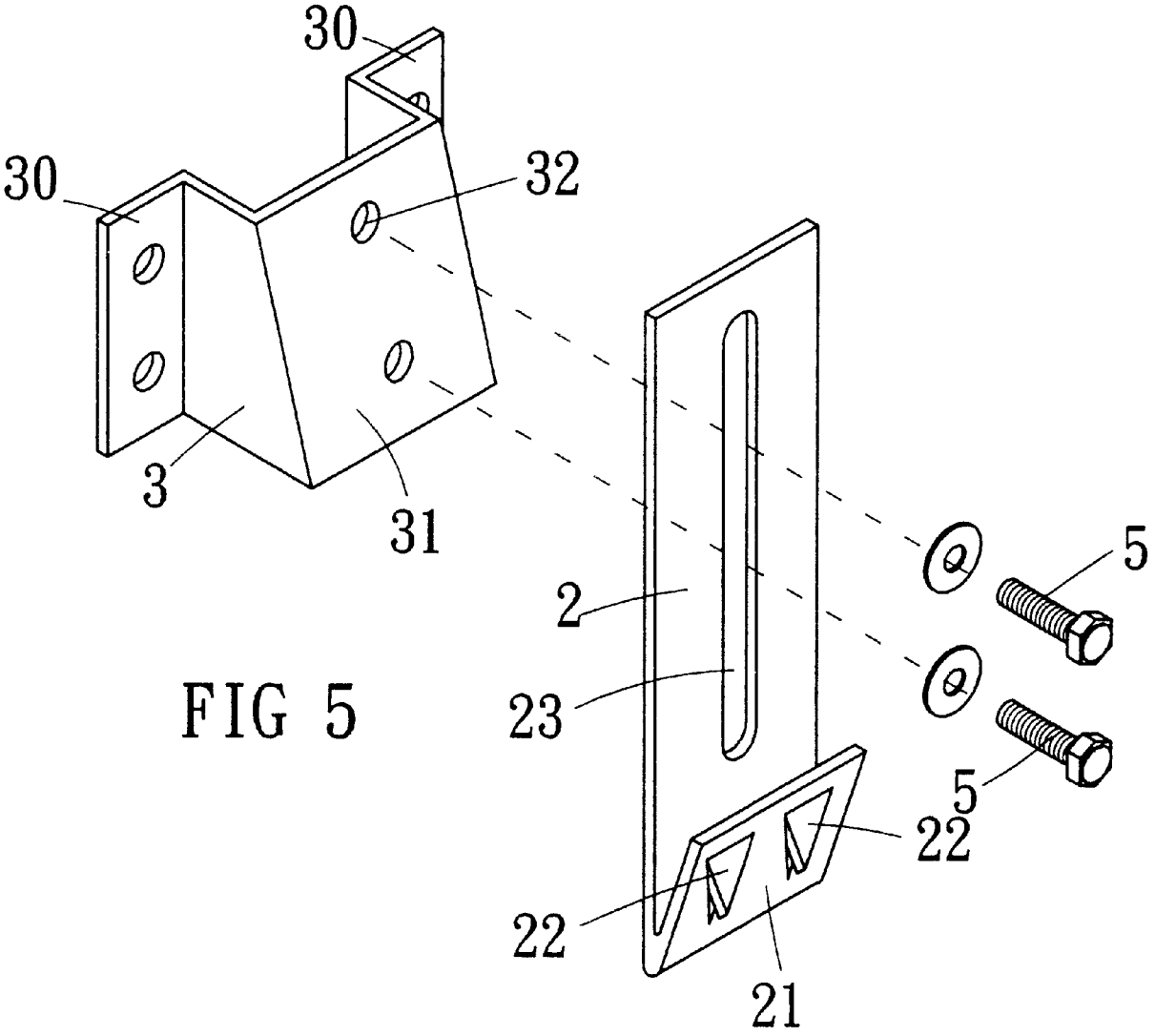
FIG. 5 is a perspective exploded view of a slabstone positioning device of another preferred embodiment in accordance with the present invention.
Figure 6:
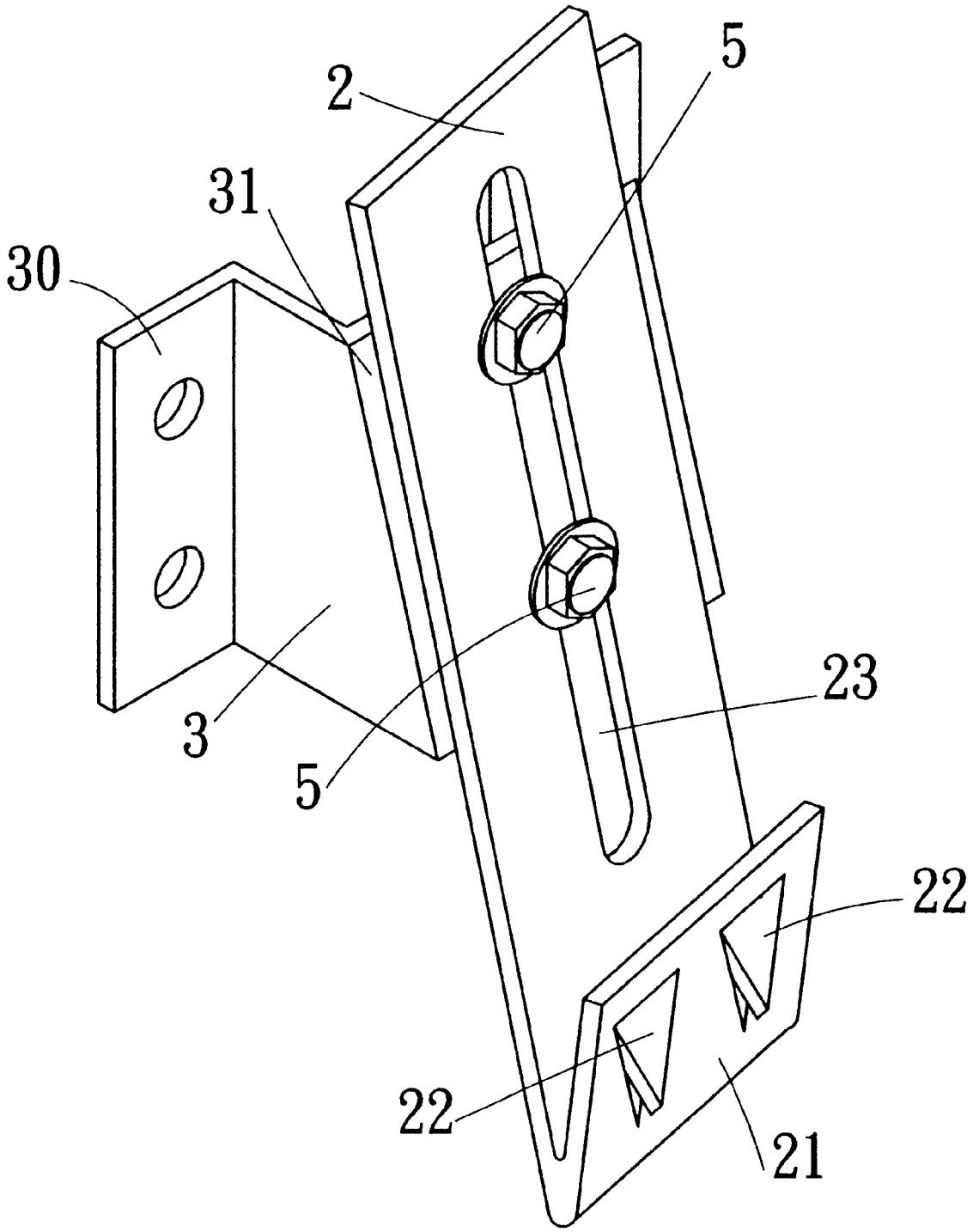
FIG. 6 is a perspective assembly view of a slabstone positioning device of another preferred embodiment in accordance with the present invention.

Referring to FIGS. 5 and 6, another slabstone positioning device comprises an adjustment seat 3, a metal positioning plate 2, an upward bent portion 21 connected to the metal positioning plate 2, and two triangular downward protrusions 22 disposed on the upward bent portion 21. A slot 23 is formed on the metal positioning plate 2. The adjustment seat 3 has a bevel 31, two lateral plates 30, and a plurality of through holes 32 formed on the bevel 31. A bolt 5 fastens the adjustment seat 3 and the metal positioning plate 2 together via the slot 23 and the respective through hole 32. The lateral plates 30 are positioned on a cement wall 4.

Figure 7B:
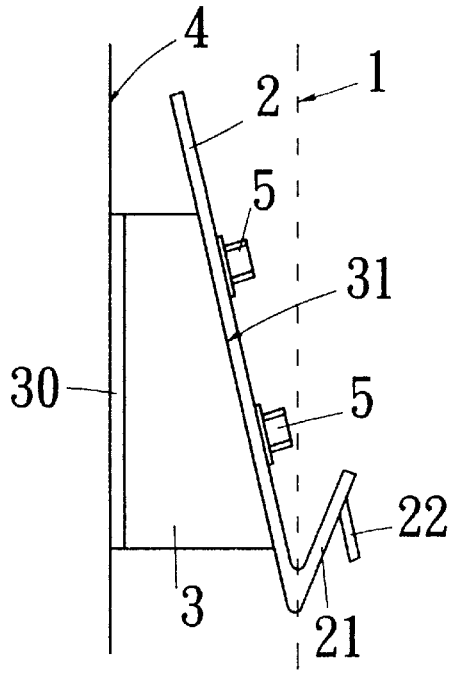
FIGS. 7A and 7B are schematic views illustrating an adjustment of a slabstone positioning device of another preferred embodiment in accordance with the present invention.
Figure 7A:
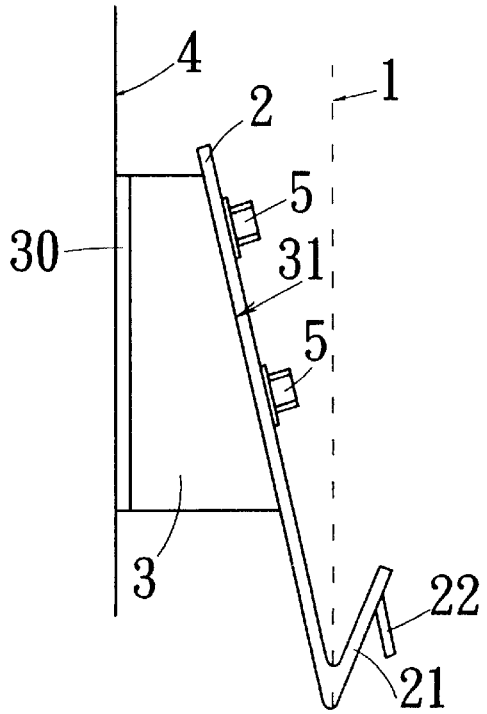

Referring to FIGS. 7A and 7B, the distance between the cement wall 4 and the slabstone 1 can be adjusted. Referring to FIG. 7A, the metal positioning plate 2 is moved downward so that the distance between the cement wall 4 and the slabstone 1 is enlarged. Then the bolt 5 fastens the adjustment seat 3 and the metal positioning plate 2 together. Therefore, the slabstone 1 is parallel to the cement wall 4. Referring to FIG. 7B, the metal positioning plate 2 is moved upward so that the distance between the cement wall 4 and the slabstone 1 is shortened. Then the bolt 5 fastens the adjustment seat 3 and the metal positioning plate 2 together. Therefore, the slabstone 1 is parallel to the cement wall 4.

Figure 8:
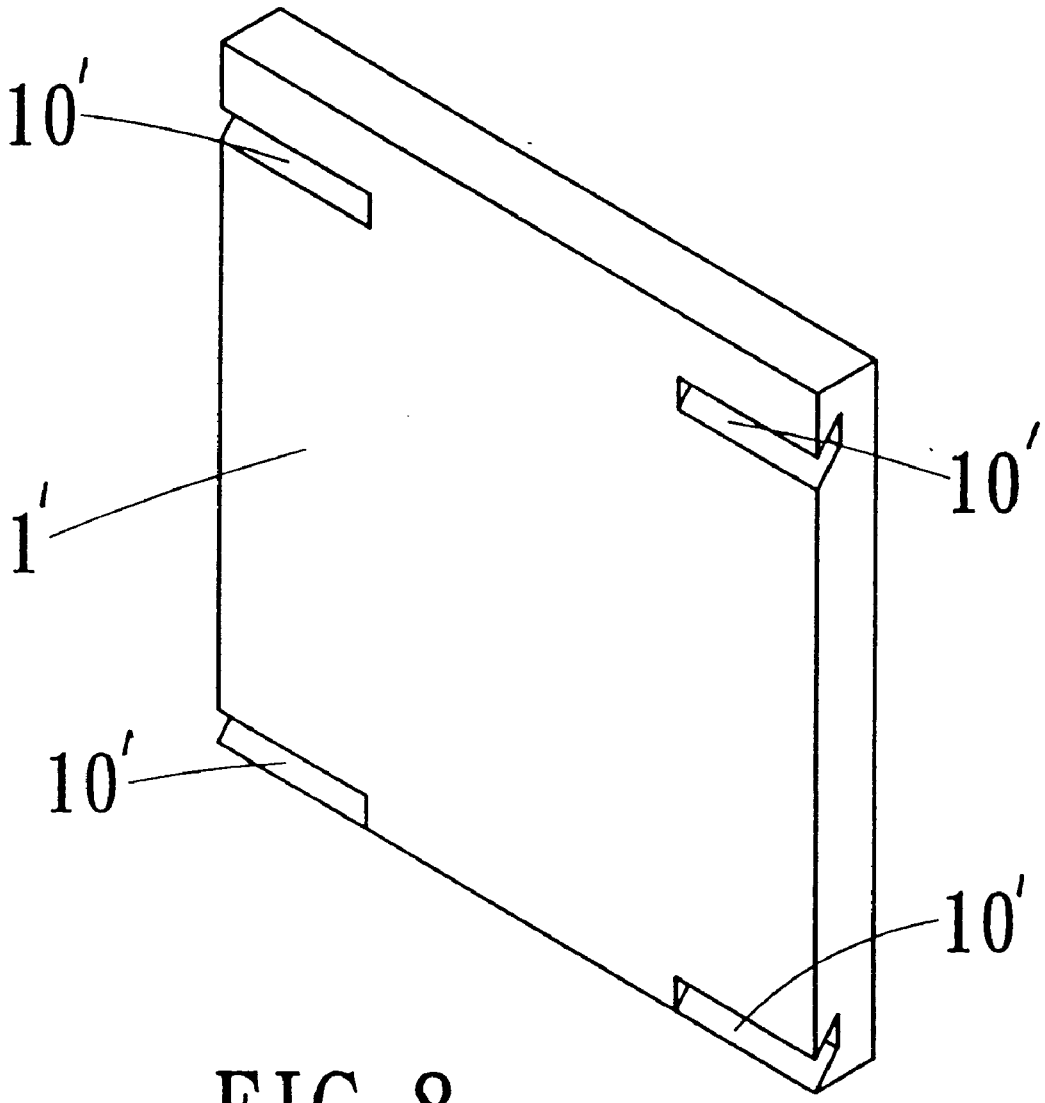
FIG. 8 is a perspective view of a slabstone.

Referring to FIG. 8, another slabstone 1' has four slant recesses 10' formed on four corners of the slabstone 1'. It is preferable to form the slant recesses 10' on the edges of the slabstone 1'. Therefore, it is easy to insert the upward bent portion 21 into the respective slant recess 10'.

Figure 9:
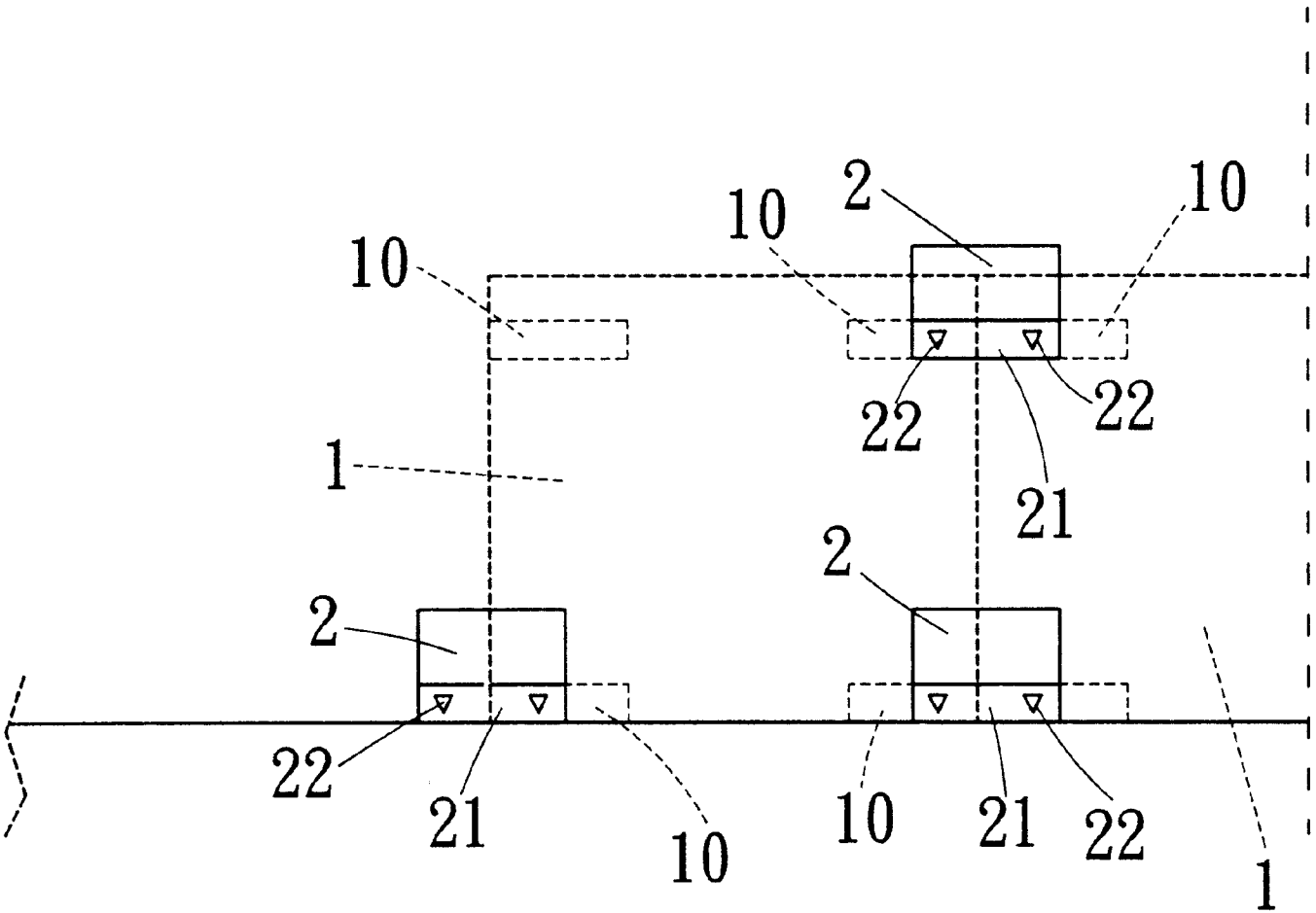
FIG. 9 is a schematic view illustrating an engagement of a slabstone and three slabstone positioning devices of another preferred embodiment in accordance with the present invention.

Referring to FIG. 9, the metal positioning plate 2 has a wide width. Therefore, one triangular downward protrusion 22 positions the first slabstone and the other triangular downward protrusion 22 positions the second slabstone.

The present invention has the following advantages. The material of the slabstone can be saved about one third. The material of the slabstone positioning device can be saved. The construction of the slabstones is easy and fast. After a long period of usage, the adhesive may be oxidized to become useless. However, the slabstone will not be disengaged from the cement wall 4 for a long period of time.

The invention is not limited to the above embodiment but various modification thereof may be made. Further, various changes in form and detail may be made without departing from the scope of the invention.

I claim:

1. A device for positioning slabstone on a cement wall comprising, in combination:

a metal positioning plate, an upward bent portion connected to the metal positioning plate, a downward protrusion disposed on the upward bent portion, a slabstone including a slant recess extending inwardly from a surface of the slabstone, and at least a fastener for fastening the metal positioning plate on the cement wall, with the upward bent portion and downward protrusion inserted in the slant recess of the slabstone and engaging the opposite interior surfaces of said slant recess.

2. A slabstone positioning device as claimed in claim 1, wherein a slot is formed on the metal positioning plate and allows movement of the metal positioning plate.

3. A device for positioning slabstone on a cement wall comprising, in combination:

a metal positioning plate, an upward bent portion connected to the metal positioning plate a downward protrusion disposed on the upward bent portion.

a slabstone including a slant recess, at least a fastener for fastening the metal positioning plate on the cement wall, with the upward bent portion and downward protrusion inserted in the slant recess of the slabstone, an adjustment seat, and a bolt fastening the adjustment seat and the metal positioning plate together, with the adjustment seat being adapted to be fastened by the fastener to the cement wall.

4. A slabstone positioning device as claimed in claim 3, wherein the adjustment seat has a bevel, two lateral plates for positioning on the cement wall and receiving the fastener, and a plurality of through holes formed on the bevel and receiving the bolt.

5. A device for positioning slabstone on a cement wall comprising, in combination:

a metal positioning plate an upward bent portion connected to the metal positioning plate, a downward protrusion disposed on the upward bent portion.

a slabstone including a slant recess, wherein a slot is formed on the metal positioning plate and allows movement of the metal positioning plate, at least a fastener for fastening the metal positioning plate on the cement wall, with the upward bent portion and downward protrusion inserted in the slant recess of the slabstone; and an adjustment seat, and a bolt fastening the adjustment seat and the metal positioning plate together, with the adjustment seat being adapted to be fastened by the fastener to the cement wall.

6. A slabstone positioning device as claimed in claim 5, wherein the adjustment seat has a bevel, two lateral plates for positioning on the cement wall and receiving the fastener, and a plurality of through holes formed on the bevel and receiving the bolt.

* * * * *